US007896086B2

(12) United States Patent
Guerrero et al.

(10) Patent No.: US 7,896,086 B2
(45) Date of Patent: Mar. 1, 2011

(54) LOGGING TOOL DEPLOYMENT SYSTEMS AND METHODS WITHOUT PRESSURE COMPENSATION

(75) Inventors: Julio C. Guerrero, Cambridge, MA (US); Agathe Robisson, Cambridge, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 140 days.

(21) Appl. No.: 11/962,657

(22) Filed: Dec. 21, 2007

(65) Prior Publication Data

US 2009/0159292 A1 Jun. 25, 2009

(51) Int. Cl.
*E21B 33/02* (2006.01)

(52) U.S. Cl. ..... 166/381; 166/85.4; 166/84.1; 277/343

(58) Field of Classification Search ..... 166/381, 166/85.4, 84.1; 277/343
See application file for complete search history.

(56) References Cited

U.S. PATENT DOCUMENTS

| | | | | |
|---|---|---|---|---|
| 2,866,217 | A * | 12/1958 | Dean | 15/220.4 |
| 4,480,703 | A * | 11/1984 | Garrett | 175/195 |
| 4,531,580 | A * | 7/1985 | Jones | 166/84.3 |
| 5,890,534 | A | 4/1999 | Burge et al. | |
| 5,901,964 | A * | 5/1999 | Williams et al. | 277/326 |
| 6,056,055 | A | 5/2000 | Falconer et al. | |
| 6,328,111 | B1 | 12/2001 | Bearden et al. | |
| 6,808,021 | B2 * | 10/2004 | Zimmerman et al. | 166/381 |
| 7,237,618 | B2 * | 7/2007 | Williams | 166/387 |
| 7,278,494 | B2 * | 10/2007 | Williams | 166/387 |
| 2006/0118294 | A1 | 6/2006 | Haakenson | |
| 2007/0079997 | A1 | 4/2007 | Chan et al. | |
| 2009/0025942 | A1 * | 1/2009 | Hall et al. | 166/381 |

FOREIGN PATENT DOCUMENTS

| | | |
|---|---|---|
| EP | 1157188 B1 | 5/2005 |
| GB | 2347156 A | 8/2000 |

OTHER PUBLICATIONS

Patent Cooperation Treaty, International Search Report, dated Apr. 14, 2009, 3 pages.

* cited by examiner

*Primary Examiner* — Shane Bomar
*Assistant Examiner* — Elizabeth C Gottlieb
(74) *Attorney, Agent, or Firm* — Brigid Laffey; Vincent Loccisano; James McAleenan

(57) ABSTRACT

Systems and processes are provided for safely facilitating transfer of down-hole devices through an adaptive seal assembly capping a well under pressure. At least one dynamic seal is provided having a size and shape to accommodate varying cross section of an elongated down-hole device, such as a logging tool. The adaptive seal assembly includes a mating flange for coupling its open end to a reversibly sealable wellhead fixture. A pressure is maintained along a wellbore side of the reversible seal, while the aperture is varied according to the varying cross section of the down-hole device as it is translated along the axis. More than one dynamic seals can be actuated in a controlled sequence to apply axial thrust in a preferred direction to the tool. One or more robotic systems can be provided to further expedite manipulation of at least one of the tool and the vessel.

26 Claims, 14 Drawing Sheets

LOGGING TOOL DEPLOYMENT SYSTEMS AND METHODS WITHOUT PRESSURE COMPENSATION

FIELD OF THE INVENTION

The present invention relates generally to the field of conveying equipment into wells, and more particularly to transporting equipment through an open end of a well that may contain pressure, while maintaining a pressure barrier at all times.

BACKGROUND OF THE INVENTION

Underground formations may exist at substantial elevated pressures posing challenges during exploration and production. In many instances, the pressures are great enough to produce an elevated pressure differential at a wellhead relative to ambient pressure. Failure to control such pressure differentials could result in an undesirable situation referred to as a blowout—an uncontrolled flow of reservoir fluids into the wellbore, and sometimes catastrophically to the surface.

Typically, a wellhead fixture including a pressure controller is mounted on the upper of the well to isolate wellbore pressures from an ambient pressure. During exploration and production, however, there remains a need to install and/or remove down-hole devices from the well. For example, logging tools designed to evaluate a formation and/or well conditions are inserted into the well, lowered to various depths as may be required during exploration, and later removed from the well, without jeopardizing crew, equipment, or production of the well. Presently, transfer of such logging tools through an open of a well under pressure can be accomplished using a pressure-controlling wellhead fixture configured to allow for transfer of the logging tool while maintaining a pressure barrier at the wellhead. One such class of fixtures is known generally as Christmas trees, including a configuration of valves and access fittings. Another such class of wellhead fixtures is known generally as blowout preventors (BOPs). Either class of wellhead fixtures can be configured with facilities to enable safe access for well intervention apertures. For example, BOPs can include an open channel with one or more reversibly sealable elements configured to open to allow passage of the logging tool, drill string, or thrust tube and closing thereafter to form a pressure barrier.

At least one such process of putting drill pipe or other down-hole devices into a well under pressure with BOPs maintaining a pressure barrier is referred to as snubbing. If the well has been closed with a so-called ram-type BOP, larger diameter features of the down-hole devices, such as tools or joints will not pass by the closed ram element. To keep the well closed another ram-type BOP or an annular BOP is included in series. The first ram element must be opened manually, then the down-hole device lowered until the larger diameter feature is just below the ram element, and then closing the first ram element again. The second ram element is then opened allowing the larger diameter element to pass. This procedure is repeated whenever a larger diameter feature, such as a tool or tool joint must pass by a ram-type BOP. Exercising such care in dealing with larger diameter features by snubbing is generally a time consuming proposition.

If only an annular BOP has been closed rather than the ram-type BOP, the drill pipe or other down-hole device may be slowly and carefully lowered into the wellbore, since the annular BOP opens slightly to permit the larger diameter feature to pass through. In snubbing operations, the pressure in the wellbore acting on the cross-sectional area of the tubular element (i.e., down-hole device) can exert sufficient force to overcome the weight of a drill string, so the string must be pushed (or "snubbed") back into the wellbore. Such thrust can be provided by a coil tubing unit pushing to a proximal end of a tool or axial array of tools within the wellbore. Such an axial array of tools is referred to as a tool string.

Applying down-hole axial thrust to such an elongated tool or string of tools generally requires the use of a rig or derrick providing lateral support to the tool or string of tools suspended above the wellhead fixture. Such strings are typically assembled vertically above a wellhead fixture before insertion, requiring tall rigs. The rig itself is constructed above the open end of the wellhead fixture and directed along the wellbore axis and may extend from 10 to 100 feet or more, depending upon the length of the tool or tool string. An array of multiple interconnected tools is referred to as a tool string. Such strings are typically assembled vertically above a wellhead fixture before insertion, requiring tall rigs. Unfortunately, construction of such a rig or derrick adds to time and complexity on-site during any such deployment and extraction procedure. The rigs must be provided, constructed, used, deconstructed and removed. Such on-site access time can be quite expensive, particularly for offshore applications, thus any procedures leading to delay, such as snubbing and rig construction, are highly undesirable.

SUMMARY OF THE INVENTION

Systems and processes are described for facilitating rapid transfer of down-hole devices through a pressure controlling wellhead fixture capping a well under pressure, without requiring a rig and without jeopardizing operators, equipment, or the well itself. An adaptive seal assembly is provided that is sized and shaped to accommodate down-hole devices of varying cross section. The assembly includes a housing with a mating flange for coupling the open end to a reversibly sealable wellhead fixture. One or more dynamic sealing elements are disposed between the housing and the down-hole device forming a pressure barrier between the well and ambient environment. Once the pressure barrier has been established, any reversible seals in the wellhead fixture can be opened, allowing for substantially unhindered transfer of the down-hole device in a preferred direction, either into or out of the well. Preferably, the dynamic seal element is configured to maintain a seal against varying cross section of the down-hole device as it is translated along axis.

One embodiment of the invention relates to a process for transferring a down-hole device across an open end of a well under pressure. The process includes attaching one end of an adaptive seal assembly to an open end of the well under pressure. The adaptive seal assembly is accessible at both ends and defines a passage therethrough. The down-hole device is positioned at least partially within the passage defined by the adaptive seal assembly. An interior region defined between an interior surface of a housing of the adaptive seal assembly and an adjacent periphery of the down-hole device is sealed. The seal provides a barrier isolating an elevated wellbore pressure within the well from an ambient pressure. An axial force is applied to a proximal end of the down-hole device, translating the down-hole device through the open end of the well under pressure. The seal between the housing and the down-hole device is automatically readjusted responsive to any cross sectional variations of the down-hole device. Readjustment of the seal maintains pressure isolation as the down-hole device is translated through the assembly.

Another embodiment of the invention relates to a system for transferring a down-hole device across an open end of a well under pressure. The system includes an adaptive seal assembly having a housing with an enclosed side wall open at both ends and defining a passage therethrough. The housing includes a mounting flange at one end, configured for securely mounting the adaptive seal assembly in relation to the open end of the well under pressure. At least one dynamic seal element is positioned within an interior region defined between an interior surface of the enclosed side wall and an adjacent periphery of the down-hole device. The dynamic seal element is configured to seal an elevated pressure in the wellbore with respect to ambient pressure. The assembly also includes an actuator configured to adjust the at least one dynamic seal element between open and closed configurations. A sealing engagement can be maintained by readjustment of the dynamic seal element allowing pressure isolation to be maintained as the down-hole device is translated through the assembly.

Yet another embodiment of the invention relates to a process for transferring a down-hole device across an open end of a well under pressure. The process includes at least one of robotically transferring the down-hole device between a storage location and the open end of the well under pressure and robotically positioning the down-hole device relative to the open end of the well under pressure.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

An adaptive seal assembly including at least one dynamic seal is provided in a housing mountable to a wellhead fixture. The adaptive seal assembly includes facilities to vary an aperture of the dynamic seal to maintain a pressure along a wellbore side of the reversible seal including devices having variations in cross section when translated along a wellbore axis. The reversible seal is sized and shaped to accept any cross section of the down-hole device. Having sealed against wellbore pressure, safety sealing features provided by the wellhead fixture are necessary. Thus, insertion or extraction of the device can be accomplished rapidly, without the need for snubbing. Once transfer of the tool has been completed, the wellhead fixture can be re-sealed either against the device, a coil tube or drill string applying thrust to the device, or completely sealed, allowing the well to resume normal operations.

The dynamic seal includes an aperture than can be opened wide enough to allow the widest portion of a device to pass. Each tool of a tool string can be inserted individually with interconnections performed at the wellhead fixture. Accordingly, there is no need for a separate rig or derrick, since the tools are supported in the assembly. In some embodiments, support equipment can be provided to manipulate the tools and chamber, such as a crane or one or more robotic arms.

Figure 1:
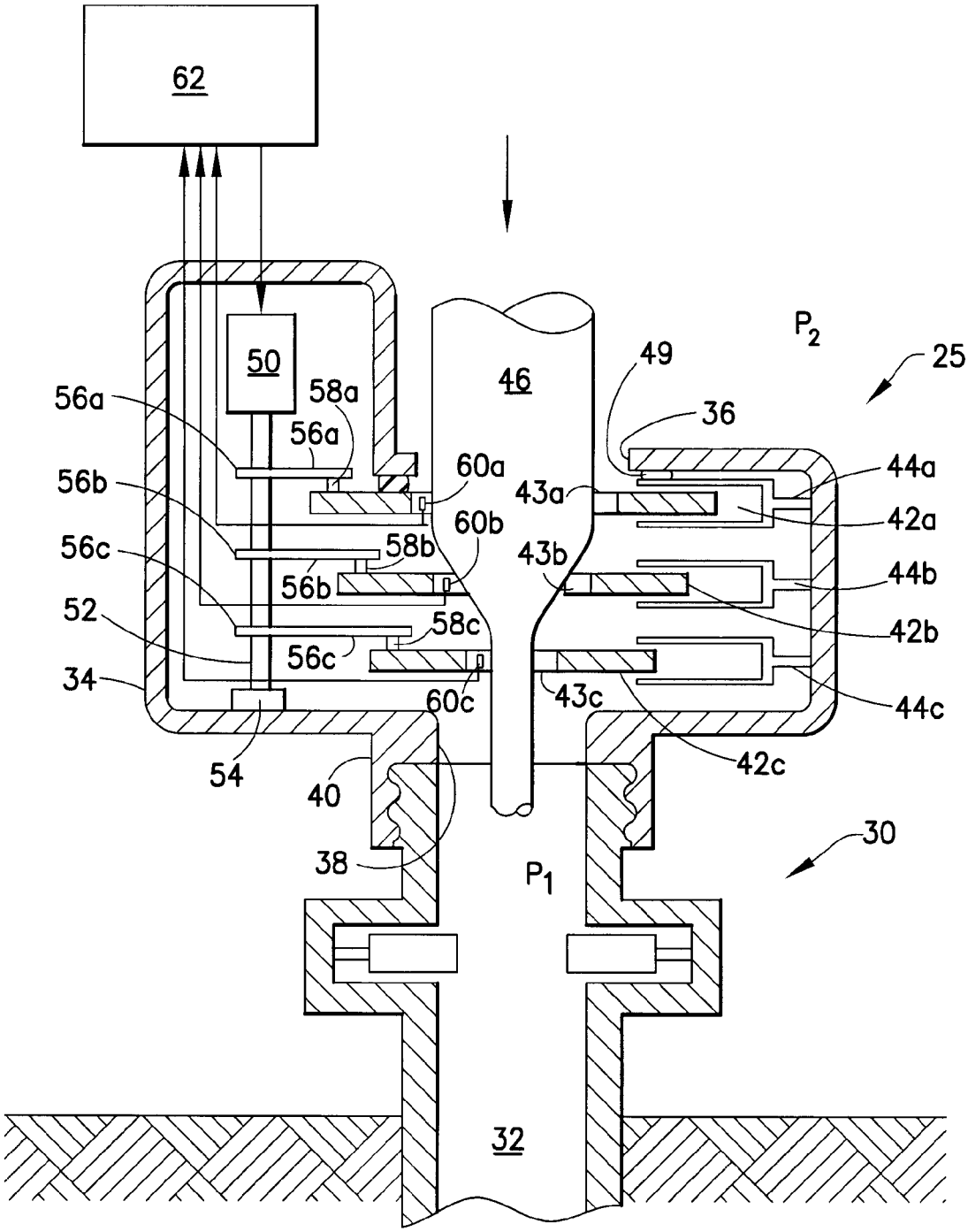
FIG. 1 is a sectional schematic view of one embodiment of an adaptive seal assembly according to the present invention.

An exemplary embodiment of an adaptable seal assembly 25 is illustrated in FIG. 1. The adaptive seal assembly 25 includes a housing 34 having a user access aperture 36 at one end and a wellbore access aperture 38 at an opposite end. Preferably the housing 34 includes a mounting flange 40 adjacent to the wellbore access aperture end adapted for attachment to an open end of a wellhead fixture 30. When the housing 34 is attached to an open end of the wellhead fixture 30, the user access aperture 36 is also aligned with the wellbore access aperture 38, both positioned along an axis of the wellbore 32.

The adaptive seal assembly 25 includes an array of dynamic sealing elements 42*a*, 42*b*, 42*c* (generally 42). Each dynamic sealing element 42 of the array is disposed at a respective location along the wellbore axis. In some embodiments, the dynamic sealing elements 42 are annular structures including a central aperture centered along the wellbore axis. The dynamic sealing elements 42 are actuatable such that the dimensions of the internal aperture vary when actuated between open and closed positions. When a down-hole device such as a logging tool 46 is inserted within the central aperture of the dynamic sealing element 42, the dynamic sealing element 42 can be actuated to close against an external surface of the logging tool 46 forming a seal along a perimeter of an adjacent cross section of the tool 46.

Each of the dynamic seal elements 42 can be held in place with respect to the housing 34. For example, each of the dynamic seal elements can be supported by a respective dynamic seal support bracket 44*a*, 44*b*, 44*c* (generally 44) securely attached to the housing 34. The dynamic seal supporting brackets 44 maintain the relative axial positioning of the dynamic seal elements 42 while allowing the dynamic seal elements 42 to vary between open and closed positions.

In some embodiments, one or more of the dynamic seal elements 42 include a respective compliant seal 43 positioned along an internal perimeter of its respective central aperture. The compliant seal 43 is pinched between the perimeter of the internal aperture of the dynamic seal 42 and the adjacent exterior surface of the logging tool 46. For cylindrical applications, the compliant seal can include an annular structure formed of an elastomeric material extending for a restricted length along the wellbore axis. When the dynamic seal 42 is in a closed position, the compliant seal 43 forms a sufficient seal to maintain a pressure barrier between a wellbore pressure $P_1$ along one side of the dynamic seal 42 and a different pressure along an opposite side of the dynamic seal 42, without requiring the dynamic seal to clamp hard against the external surface of the logging tool 46. Consequently, the logging tool 46 is slidable along the wellbore axis when a thrust is applied, while still maintaining a seal. One or more sealing members 49 can be included between one or more of the dynamic seal elements 42 and an adjacent surface of the housing 34 to maintain a pressure differential thereacross.

The dynamic seal elements 42 can be formed as a closed-loop kinematics mechanism having the following capabilities: (i) converts the area of a circle into a ring that has an outer diameter larger than the initial diameter of the circle, and (ii) modifies the inner radius of a cylindrical device enlarging or reducing its diameter. The closed-loop kinematics mechanism can be formed from a series of basic linkages that pivot with respect to each other. As one of the rigid linkages pivots with respect to the other, the other pairs of rigid linkages of the closed-loop mechanism similarly pivot. Operation of the dynamic seal elements 42 can be controlled by one or more of the shapes of the rigid linkages and the locations of the pivots. Such closed-loop mechanisms can be referred to as deployable structures, which are described in more detail in U.S. patent application Ser. No. 11/247,918, entitled "Mechanical crawler", filed on Oct. 11, 2005, commonly owned and incorporated herein by reference in its entirety. Although the exemplary embodiments are directed to cylindrical applications, dynamic seal elements can be provided having internal apertures shaped to accommodate polygonal tools (e.g., rectangular), ellipsoidal tools, and complex-shaped tools having perimeters with a combination of linear and curvilinear shapes.

The adaptive seal assembly 25 includes at least one actuator 50 configured to actuate the actuatable dynamic seal elements 42 between open and closed positions. In the exemplary embodiment, the adaptive seal assembly 25 includes a single actuator 50, such as a rotary motor positioned at one end of an elongated drive shaft 52. An opposite end of the drive shaft 52 is retained in a bearing 54 allowing the drive shaft 52 to rotate when a torque is provided by the motor 50. A respective transmission 56*a*, 56*b*, 56*c* (generally 56) is provided between the elongated drive shaft 52 and each of the dynamic seal elements 42. Each of the dynamic seal elements 42 can include a respective dynamic seal drive shaft 58*a*, 58*b*, 58*c* (generally 58) coupled to the respective transmission 56. Rotation of the elongated drive shaft 52 rotates the dynamic seal drive shaft 58 linked through the transmission 56 thereby actuating the respective dynamic seal element 42 between open and closed configurations depending upon direction of the rotation.

In some embodiments, the adaptive seal assembly 25 is automatically controllable. For example, a controller 62 provides commands to the actuator 50. One or more of the dynamic seal elements 42 can include a respective sensor 60*a*, 60*b*, 60*c* (generally 60). The sensors 60 are configured to provide an indication of the seal between the internal aperture of a respective dynamic seal element 42 and an adjacent external perimeter of the logging tool 46. In some embodiments, the sensor 60 can be a strain gauge provided within or along a surface of the compliant seal member 43. The strain gauge measures strain which is indicative of the seal with a greater strain indicating a tighter seal. One or more of the sensors 60 can be coupled to the controller 62. The controller 62 can be configured to operate in a feedback-loop control automatically adjusting the actuation of the one or more dynamic seal elements 42 as a function of input received from the sensors 60. The one or more actuators 50 and sensors 60 can be coupled to a remote controller 62 through a wire, an optical fiber, or a wave guide. In some embodiments, the one or more of the actuators 50 and sensors 60 can be coupled to the remote controller 62 via a wireless communications link. In some embodiments, the controller 62 is not remote, but provided within the housing 34 for a self-contained assembly 25.

Figure 2:
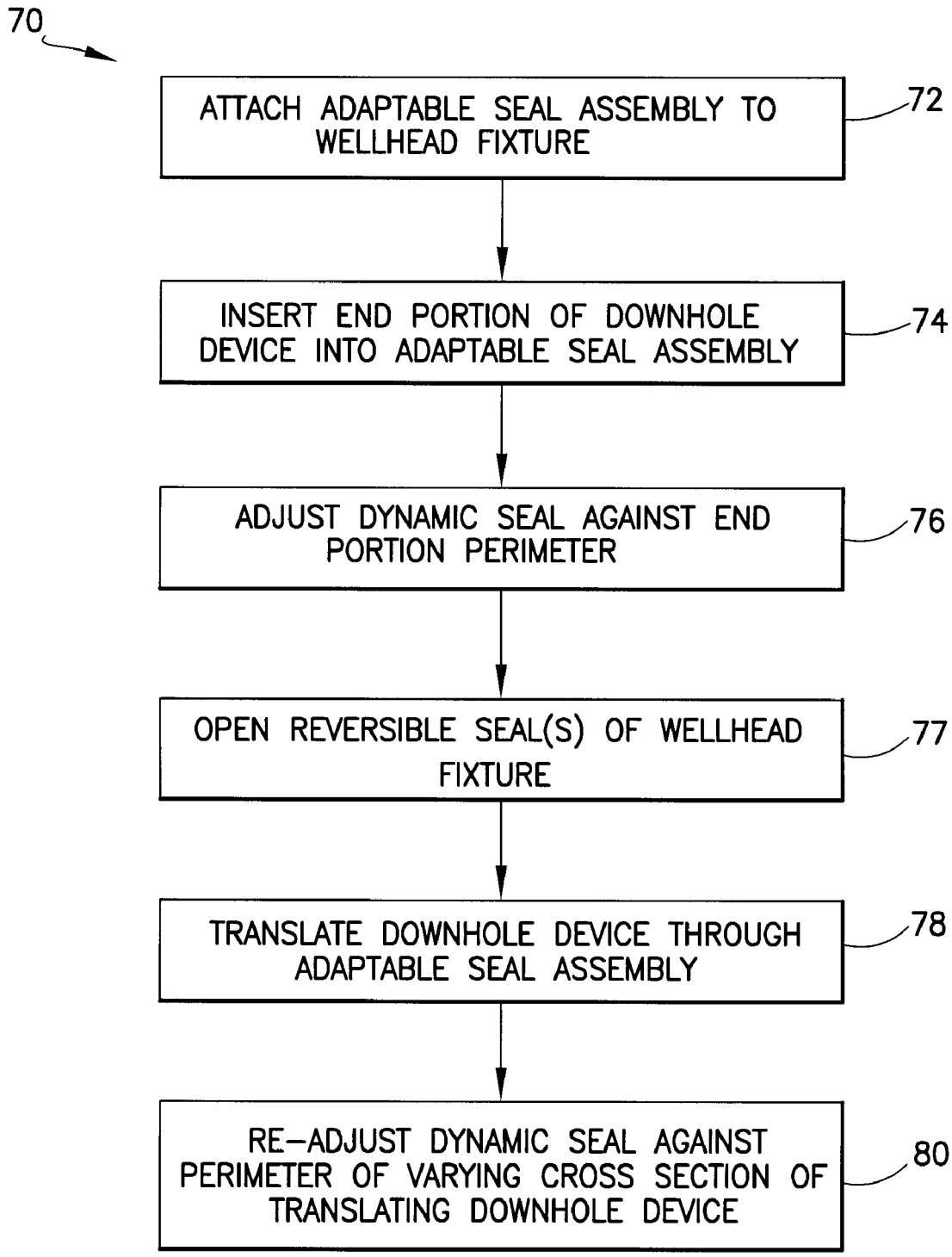
FIG. 2 provides a flow diagram illustrating an exemplary procedure for transferring a device through an opening of a well under pressure according to the present invention.

An exemplary process 70 for transferring a down-hole device such as a logging tool through an open end of a well under pressure is illustrated in FIG. 2. A top end of the well typically includes one or more wellhead fixtures. The wellhead fixtures generally include one or more reversible seals adjustable to establish a pressure barrier between a wellbore pressure and ambient pressure at the wellhead. To transport tools into and out of the well according to the present invention, an adaptable seal assembly is first attached to an open end of the wellhead fixture (72). The adaptable seal assembly includes a user access aperture and a wellbore access aperture, each positioned respectively at opposite ends of the assembly, such as the exemplary device illustrated in FIG. 1. An end portion of a logging tool is at least partially inserted into one of the apertures of the adaptable seal assembly (74). For example, in an insertion process for inserting a logging tool into the open end of the well, a distal end portion of the logging tool is inserted into the user access aperture of the adaptable seal assembly. For a removal process, a portion of the logging tool is inserted into the wellbore access aperture.

The adaptable seal assembly includes one or more dynamic seal elements. At least one of the dynamic seal elements is adjusted to form a seal against an adjacent perimeter along an external surface of the end portion of the logging tool (76). The dynamic seal can be an annular device extending in a plane perpendicular to the wellbore access. Once a seal has been established, an elevated wellbore pressure is isolated from ambient pressure surrounding the wellhead fixture. Once such a pressure barrier has been established at the adaptive seal assembly, any reversible seals provided within the wellhead fixture can be opened providing access to the depths of the wellbore (77).

A thrust is applied to the logging tool urging it in a preferred direction along the wellbore axis. The thrust translates a substantial portion of the logging tool through the adaptable seal assembly (78). Preferably one or more of the dynamic seal elements are automatically adjustable or readjusted to maintain a seal against an external surface of varying cross-section of the logging tool as the tool is translated along the axis of the well (80). Preferably such readjustment of the dynamic seals is accomplished automatically such that the seal is adjusted to maintain a controlled pressure against the adjacent external surface of the logging tool. Such pressure can be regulated using a pressure sensor at the seal and a feedback controller configured to adjust the dynamic seal actuator according to the sensed pressure thereby maintaining a pressure within a preferred pressure range.

Figure 3:
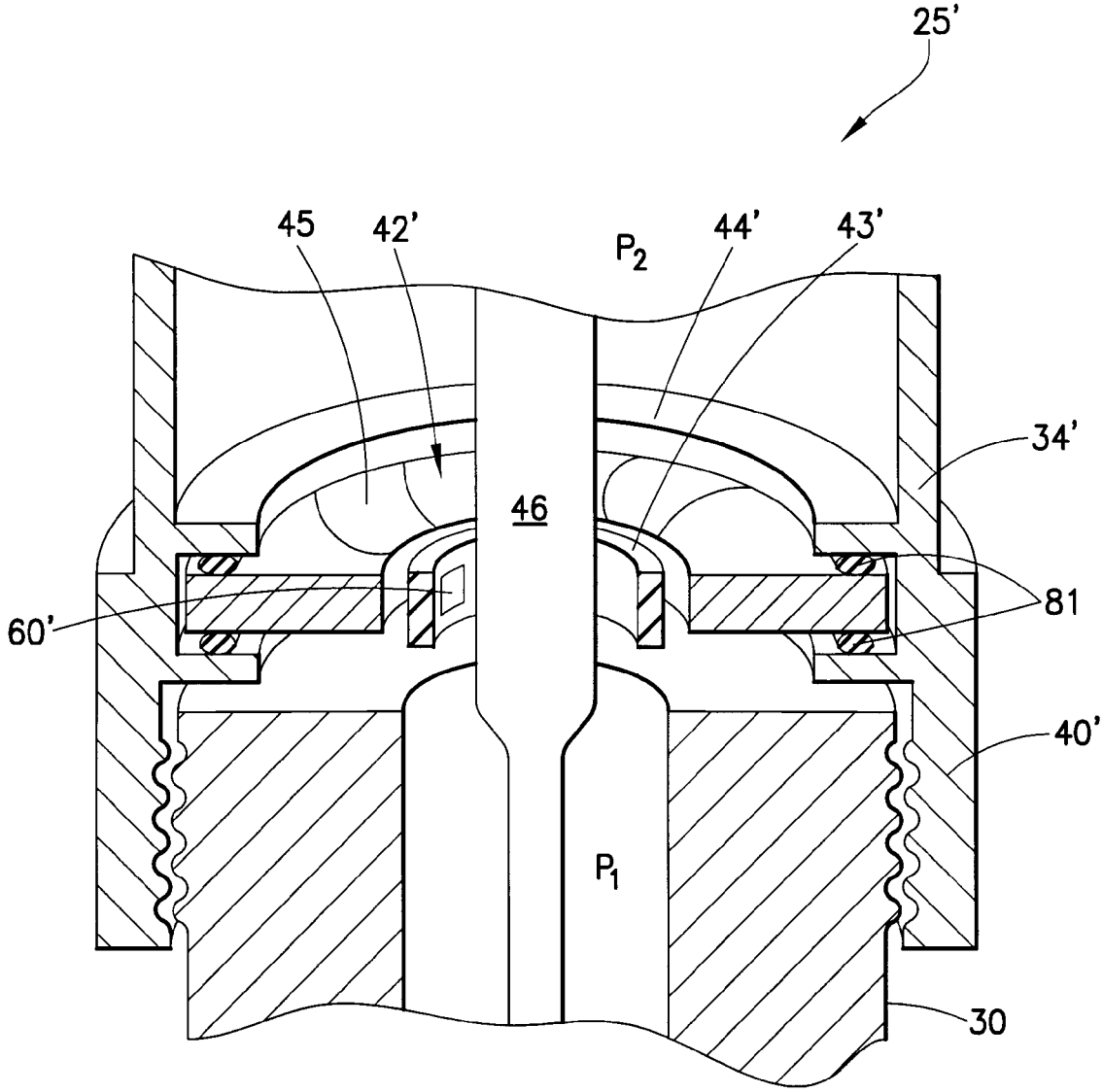
FIG. 3 is a sectional schematic view illustrating in more detail an embodiment of a dynamic seal element according to the present invention.

A more detailed view of an exemplary reversible seal 42' of an exemplary adaptive sealing assembly 25' is provided in the sectional view of FIG. 3. In some embodiments, the reversible seal 42' is formed using a dynamic-sealing, deployable structure 45. The deployable structure 45 includes at least three pivotally-joined double lever assemblies forming an enclosed mechanical linkage. Such reversibly-expandable structures are described in more detail in U.S. patent application. Ser. No. 11/962,256, entitled "System and Methods for Actuating Reversibly Expandable Structures," filed on Dec. 21, 2007, and incorporated herein by reference in its entirety. Although the exemplary embodiments are directed to cylindrical applications, reversibly-expandable structures can be provided having internal apertures shaped to accommodate polygonal tools (e.g., rectangular), ellipsoidal tools, and complex-shaped tools having perimeters with a combination of linear and curvilinear shapes.

In the illustrative embodiment, the enclosed linkage 45 forms an annular structure disposed between an interior surface of a housing 34' and an outer surface of a tool 46 positioned therein. An internal aperture of the annular enclosed mechanical linkage 45 is configured selectively to expand and contract when one or more of the double lever assemblies are manipulated. In the illustrative embodiment, an outer perimeter of the annular structure 45 remains in sealable contact with the inner wall of the housing 34' while an inner perimeter of the annular structure 45 is allowed to vary between maximum and minimum diameters according to adjustment of the mechanical linkage. Thus, the annular structure 45, when engaging the tool 46 with its inner perimeter forms a seal between the inner wall of the housing 34' and the outer surface of the tool 46. In some embodiments, a sealing member 43' is inserted between the inner perimeter of the annular structure 45 and the outer surface of the tool 46. For example, an elastomeric material 43' can be applied or fixed to the inner perimeter of the annular structure 45 such that when the inner perimeter is enclosed to engage the outer surface of the tool 46, the elastomeric material 43' is entrapped between the inner perimeter and the tool 46 forming a fluid-tight seal. In some embodiments, the elastomeric material 43' is segmented around the inner perimeter to provide a continuous seal when closed, but allowing substantial expansion without damage to the elastomeric material 43'. In some embodiments, the elastomeric material includes multiple layers of varying compliance.

A pressure sensor 60' such as a strain gauge can be positioned between the inner perimeter and the outer surface of the tool 46 as shown. For example, the pressure sensor 60' can be impregnated within the elastomeric material and configured to sense a strain indicative of the pressure exerted between the inner perimeter of the annular structure 45 when engaging the outer surface of the tool 46. Alternatively or in addition, the pressure sensor 60' can be included between the outer perimeter of the annular structure 45 and the interior surface of the housing 34', once again sensing pressure exerted when the reversible seal 42' is adjusted to form a seal. One or more pressure sensors 60' can be coupled to an external pressure monitor (not shown) providing the user with an indication of the pressure exerted. More preferably, the one or more pressure sensors 60' can be connected to a controller in a feedback control loop configuration such that the controller adjusts the reversible seal 42' in response to monitored output pressure provided by the pressure sensor 60'. The controller adjusts the inner perimeter of the reversible seal 42' until a predetermined sealing pressure is obtained. Once the desired sealing pressure is obtained, further adjustment of the annular structure terminates.

In some embodiments, one or more sealing members 81 are provided along the outer edge of the annular structure 45 and the inner surface of the housing 34'. As shown, these may include one or more elastomeric seals, washers, or o-rings 81 disposed between the outer perimeter of the deployable structure 45 and a flange 44' coupled to the inner wall of the housing 34'.

Figure 4A:
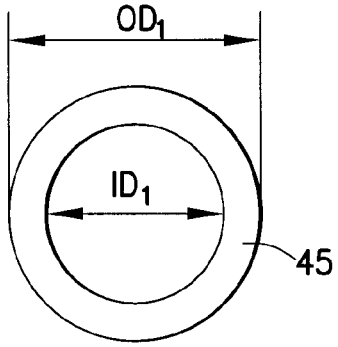
FIG. 4A and FIG. 4B illustrate a simplified axial end view of the reversible dynamic seal of FIG. 3.
Figure 4B:
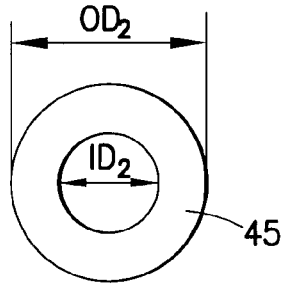

A planar view along the wellbore axis of an exemplary dynamic seal having an annular shape is illustrated in an open position in FIG. 4A and in a closed position in FIG. 4B. In an open position, the dynamic seal 45 defines an internal aperture having an internal diameter $ID_1$ and an external diameter of $OD_1$. In a closed configuration shown in FIG. 4B, the internal aperture has an internal diameter $ID_2$ less than the open internal diameter $ID_1$ and an outside diameter $OD_2$ that can be the same, greater, or less than the open outside diameter $OD_1$.

Figure 5A:
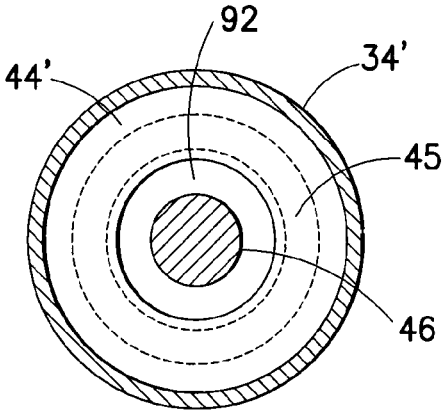
FIG. 5A and FIG. 5B illustrate an axial end view of the reversible dynamic seal of FIG. 3 mounted within one embodiment of a housing.
Figure 5B:
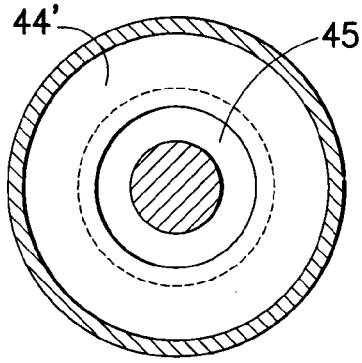
Figure 6A:
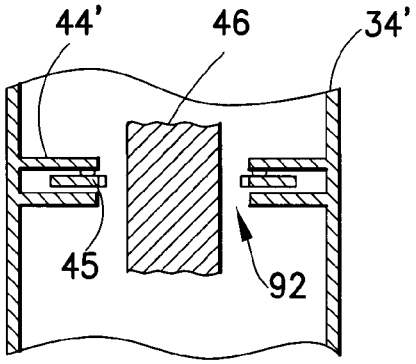
FIG. 6A and FIG. 6B illustrate a cross sectional elevation view of the reversible dynamic seal element of FIG. 3 mounted within the embodiment of a housing.

As shown in FIG. 6A, at least a portion of the dynamic seal 45 is retained within a bracket 44' retaining the dynamic seal 45 in a fixed position relative to the housing 34'. As shown in FIG. 5A, the dynamic seal 45 when opened can be at least partially or entirely contained within the bracket 44'. In the open position, a space 92 can be provided between an interior perimeter of the dynamic seal 45 and an adjacent external surface of the logging tool 46. That is, the inside diameter of the open dynamic seal $ID_1$ is greater than an adjacent outside diameter of the logging tool 46. Thus, in an open configuration, the logging tool is allowed to pass freely along the wellbore axis with respect to the dynamic seal 45.

Figure 6B:
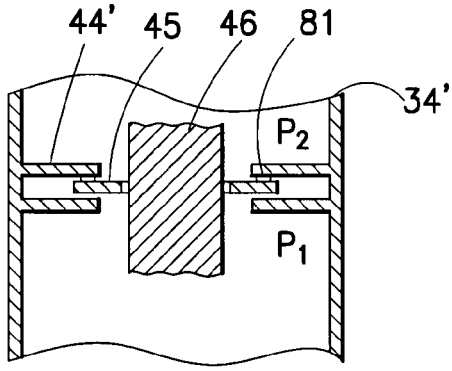

When closed, an internal perimeter of the dynamic seal 45 is urged against an adjacent external surface of the logging tool 46. Thus, the internal diameter of the closed dynamic seal $ID_2$ is approximately equal to an external diameter of the logging tool 46. Preferably, the dynamic seal 45 extends within the plane perpendicular to the wellbore axis to occlude any opening between the logging tool 46 and the bracket 44' or housing 34'. A cross-sectional side view is shown in FIG. 6B in which the dynamic seal 45 is closed against an adjacent external perimeter of the logging tool 46 with at least an outer portion of the dynamic seal 45 still residing within the bracket 44'. The bracket 44' and closed dynamic seal 45 together form a pressure barrier along the wellbore axis. In some embodiments, one or more sealing members 81 are provided to seal the outer portion of the dynamic seal 45 against the bracket. When such a seal is established, an elevated well pressure $P_1$ is maintained against a different ambient pressure $P_2$.

Figure 7:
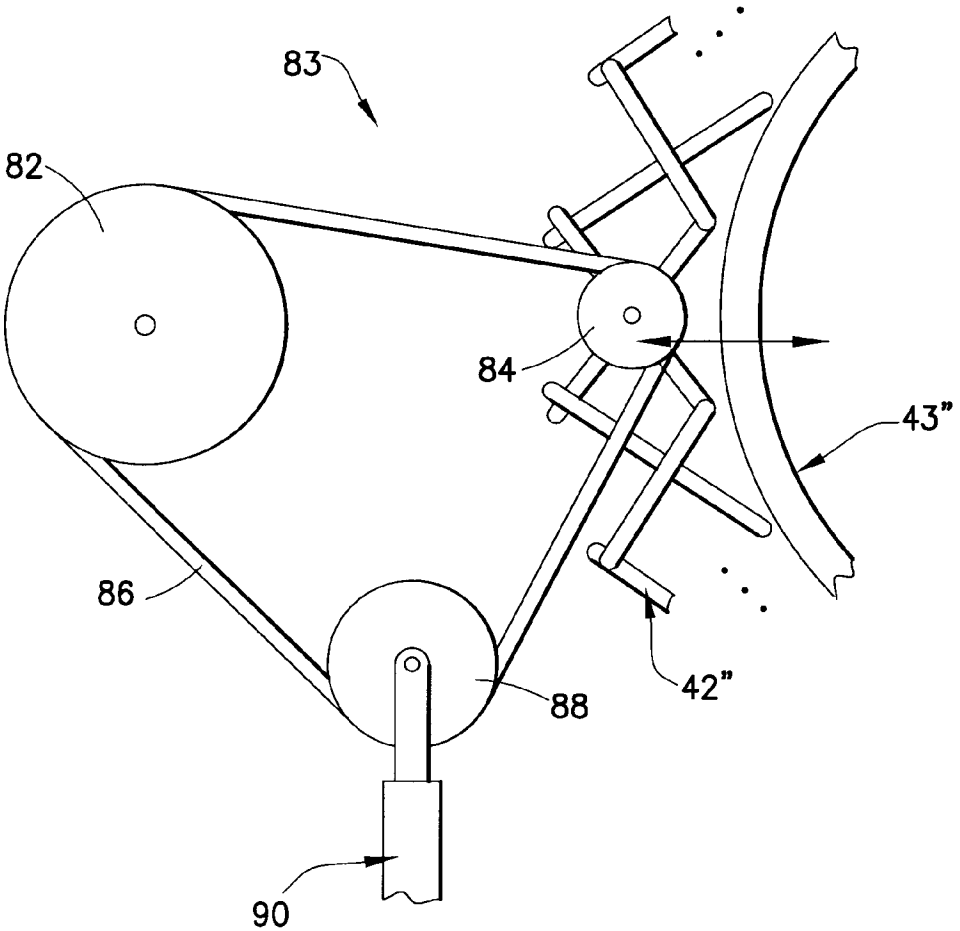
FIG. 7 is a plan view of an embodiment of a dynamic seal actuator according to the present invention.

FIG. 7 illustrates one embodiment of an actuator 83 configured to manipulate one of the joined double lever assemblies of the mechanical linkage of the reversible seal 42", thereby causing the reversible seal 42" to change its dimensions. The exemplary embodiment includes a driving wheel 82 providing a torque positioned adjacent to a driven wheel 84 coupled to one of the double lever assemblies. When the driven wheel 84 is rotated, it causes a corresponding rotation of the double lever assembly. The driving wheel 82 and driven wheel 84 can include pulleys about which a drive belt 86 is coupled. The driving wheel 82 can be connected to an electric motor providing torque to drive the driven wheel 84. Rotation of the driving wheel 82 rotates the drive belt 86, which also rotates the driven wheel 84. The driven wheel 84 typically moves in relation to the driving wheel 82 by expansion and contraction of a reversible seal 43". In the exemplary embodiment, the driven wheel 84 moves along a straight line path between the centers of the driving wheel 82 and the driven wheel 84. In some embodiments, a third wheel 88 is also provided in communication with the drive belt 86 such that the center of the third wheel 88 is displaceable in a direction non-parallel to the line joining the driving wheel 82 and the driven wheel 84 as illustrated. Preferably, the third wheel 88 is rotatably coupled to a device that displaces the third wheel with respect to the driving wheel 82 and the driven wheel 84 to maintain tension of the belt 86 when the driven wheel 84 moves toward or away from the driving wheel 82. In some embodiments, the driving wheel 82, the driven wheel 84, and the third wheel 88 can be replaced by cogs and the belt 86 replaced by a chain, to the same effect.

Figure 8:
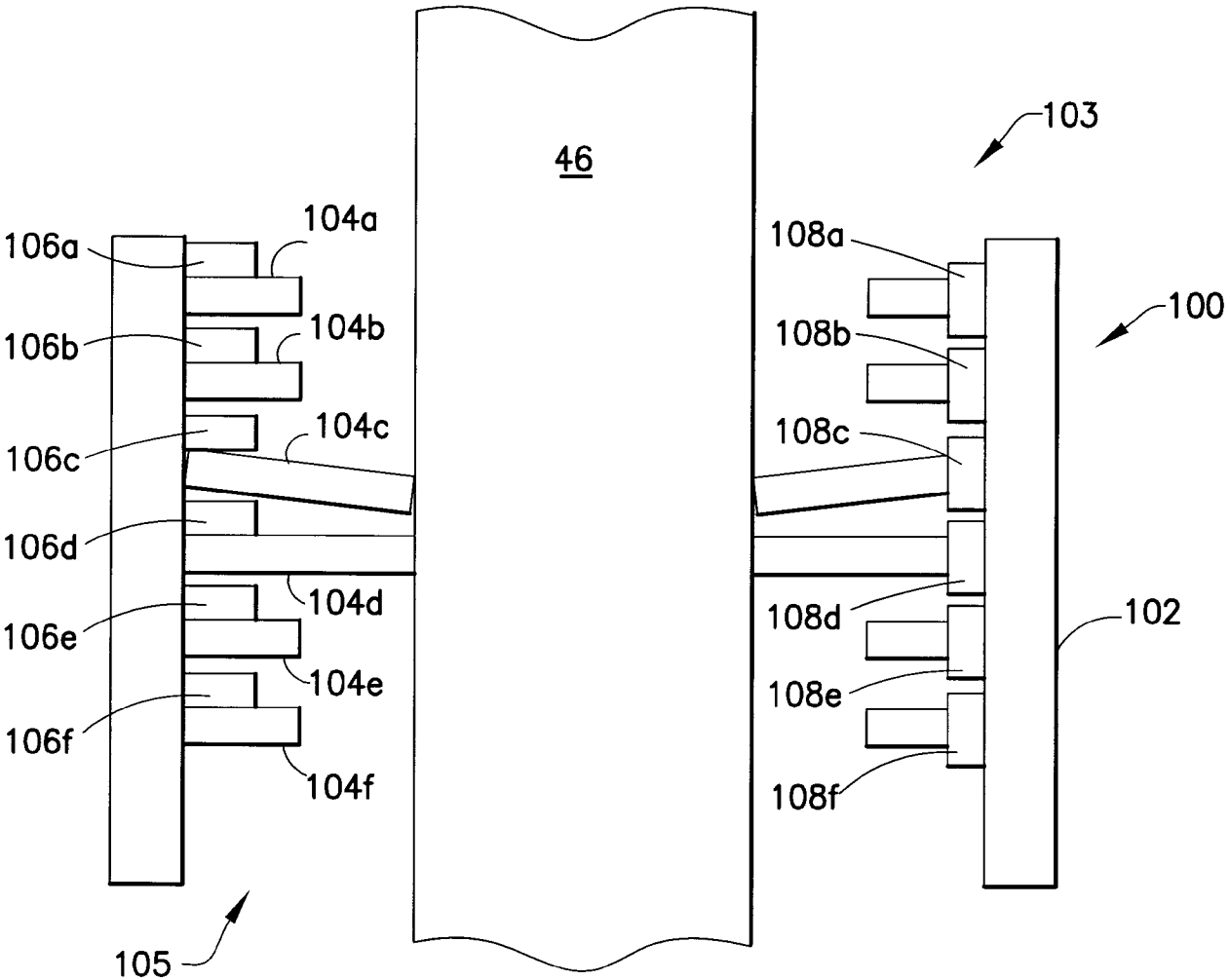
FIG. 8 is a cross-section schematic diagram of one embodiment of an adaptive sealing thrust assembly according to the present invention.

In some embodiments, the adaptive seal assembly is configured to apply a thrust to a down-hole device while also maintaining a peripheral seal about an outer surface of the down-hole device. One such class of adaptive seal assemblies providing an internal thrust capability is illustrated in FIG. 8. The adaptive seal assembly 100 includes a housing 102 having a user access aperture 103 and a wellbore access aperture 105. A down-hole device, such as a logging tool 46, can be translated through either of the user access aperture 103 or the wellbore access aperture 105, depending upon the direction of travel, through an internal cavity of the housing 102, and out the opposite side of the adaptive seal assembly 100.

In the exemplary embodiment, the adaptive seal assembly 100 includes six dynamic sealing elements 104*a* through 104*f* (generally 104). Each of the dynamic seal elements 104 includes an annular structure having a central aperture through which the logging tool 46 can traverse. Each of the dynamic seal elements 104 is also configured to vary its internal aperture between open and closed positions. In an open position, the dynamic seal element 104 is open substantially such that the logging tool 46 can pass through its central aperture without any hindrance. In a closed position, the central aperture of the dynamic seal element 104 is urged against an adjacent outer surface of the logging tool 46 forming a seal thereabout. In at least some embodiments, each dynamic seal element 104 resides in a parallel plane, orthogonal to and spaced apart along a longitudinal axis of the logging tool 46. The dynamic seal element 104 can remain orthogonal to the longitudinal axis during transitions between open and closed positions. One or more actuators 106*a* through 106*f* (generally 106) are provided to independently adjust the dynamic seal elements 104 between open and closed positions.

To provide longitudinal thrust to the logging tool 46, one or more of the dynamic seal elements 104 is configured such that it is translatable along the longitudinal axis of the logging tool 46, at least when the dynamic seal element 104 is in a closed position. Travel distances of each of the dynamic seal elements 104 are generally limited by spacing of other adjacent dynamic seal elements 104. Preferably, the at least one of the dynamic seal elements being translated clamps to the tool, such that the tool is also translated by a corresponding distance.

The adaptive seal assembly 100 also includes one or more translation actuators 108*a* through 108*f* (generally 108). The exemplary embodiment includes eight such translation actuators, one for each of the eight dynamic seal elements 104. In some embodiments, each of the translation actuators 108 is configured to translate a respective one of the dynamic seal elements at limited distance δ along the longitudinal axis of the logging tool 46. Such translation can be provided by a rotating threaded shaft linked to a mounting bracket supporting the dynamic seal element 104. Preferably, the mounting bracket is slidable along the longitudinal axis of the logging tool 46. Rotation of the threaded shaft urges the respective mounting bracket in a longitudinal direction according to the direction of rotation of the shaft. Alternatively or in addition, one or more of the dynamic seal elements is bendable allowing a perimeter of the internal aperture to translate a limited distance along the longitudinal axis according to bending of the dynamic seal 104. As illustrated, a third dynamic seal element 104*c* is configured in a closed position and bent downward while adjacent dynamic seal 104*d* is in a closed position. By a sequencing of the reversible seal actuators 106 and the translation actuators 108, a controlled thrust can be applied to the logging tool 46.

Figure 9:
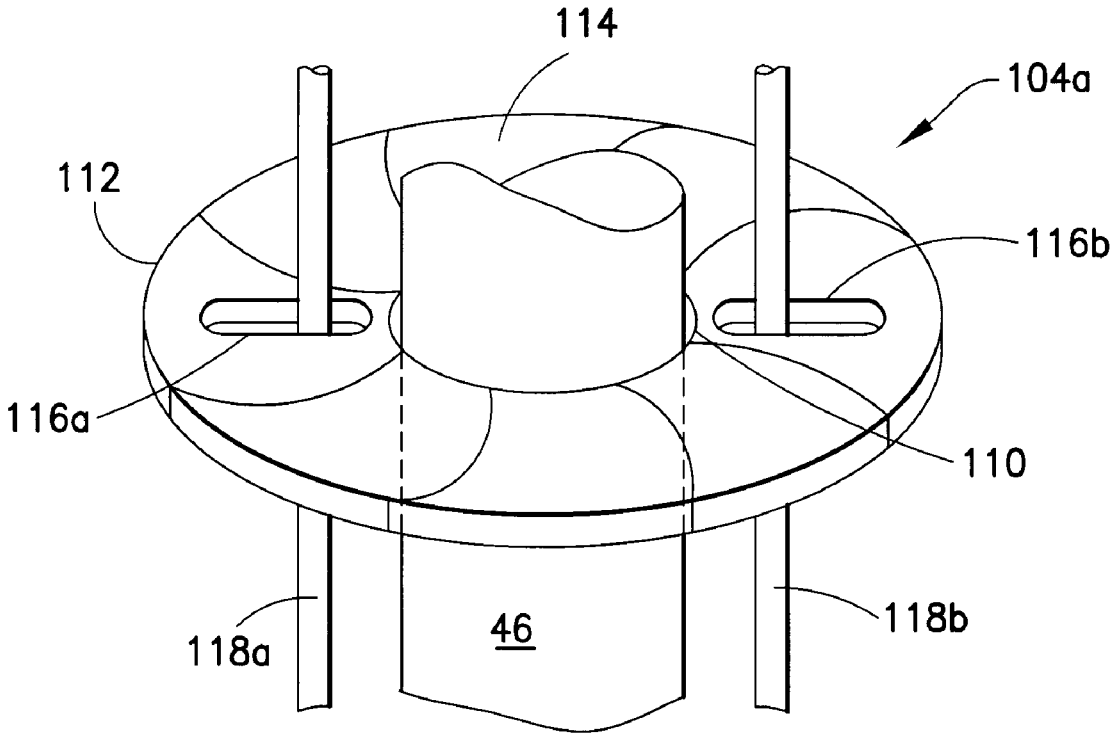
FIG. 9 is a perspective view of an embodiment of an exemplary reversible seal of the adaptive sealing thrust assembly of FIG. 8.

An exemplary embodiment of a dynamic seal 104*a* is schematically illustrated in cross section in FIG. 9. The dynamic seal 104*a* includes a deployable structure 114. The deployable structure 114 can include one or more apertures 116*a*, 116*b* to allow passage of one or more elongated threaded drive shafts 118*a*, 118*b* therethrough. The deployable structure 114 can be an annular structure similar to those described above in relation to the reversible seals. The annular structure 114 includes an internal perimeter 110 adapted to frictionally engage an adjacent outer surface of the logging tool 46. Once clamped, a translation actuator (FIG. 8) (i.e., vertical) urges the reversible seal 104*a*, now clamped to the logging tool, in a preferred direction according to the rotation of the extended threaded drive shafts 118*a*, 118*b*. The slots 116*a*, 116*b* allow for travel of the deployable structure 104*a* within the housing 102 (FIG. 8).

Figure 10A:
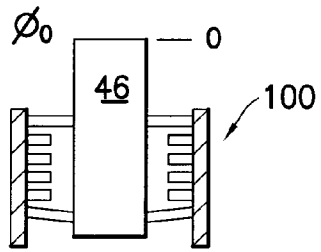
FIG. 10A through FIG. 10L together illustrate the adaptive sealing thrust assembly of FIG. 8 applying thrust to a tool according to the present invention.
Figure 10B:
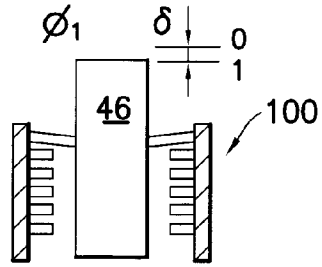
Figure 10C:
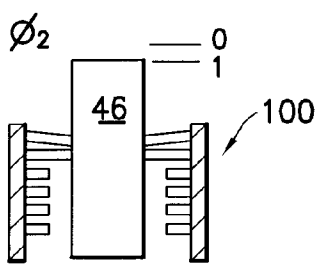
Figure 10D:
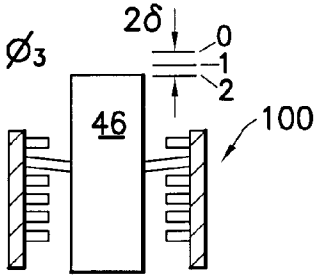

FIG. 10A through FIG. 10L together illustrate a sequencing of the dynamic seal elements 104 in a controlled manner for applying a thrust to the logging tool 46 urging the logging tool 46 in a downward direction through the internal cavity of the adaptive seal assembly 100. In the exemplary embodiment, there are twelve phases, phase 0 through phase 11. Referring to FIG. 10A illustrating phase 0, a first dynamic seal element 104*a* is illustrated in a closed position while a sixth dynamic seal element 104*f* is illustrated in a closed and translated position. A zero reference is drawn at the top of the logging tool 46 for reference as the logging tool is translated throughout the different phases. Referring next to FIG. 10B, the sixth dynamic seal element 104*f* has opened, while the first dynamic seal element 104*a*, still in a closed position, has translated downward by an amount δ, the logging tool being clamped by the first dynamic seal element 104*a* is also translated by a corresponding amount δ. In a third phase shown in FIG. 10C, the second dynamic seal element 104*b* is closed to engage an outer surface of the logging tool 46 while all other dynamic seal elements can remain in the same position. In a fourth phase, the first dynamic seal element 104*a* opens while the second dynamic seal element 104*b* is translated by an amount δ also translating the logging tool 46 by the same amount δ, now 2 δ from the Ø reference position.

Figure 10E:
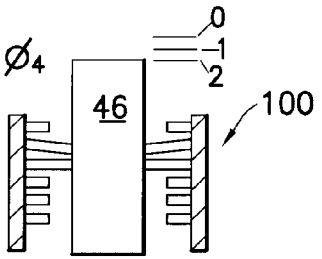
Figure 10F:
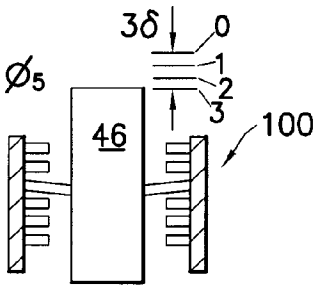
Figure 10G:
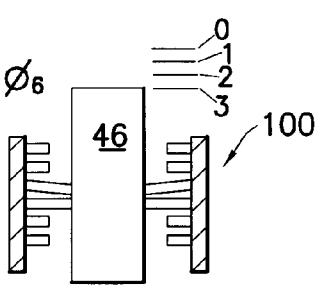
Figure 10H:
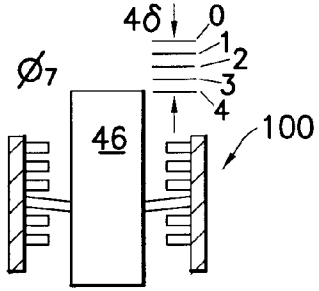
Figure 10I:
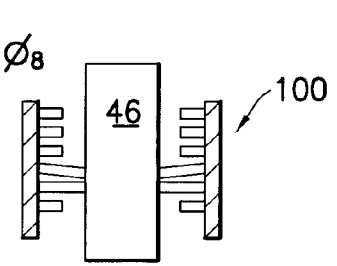
Figure 10J:
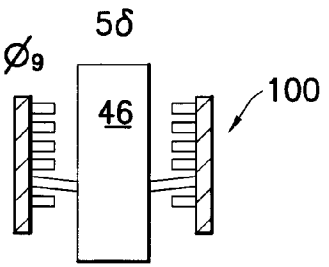
Figure 10K:
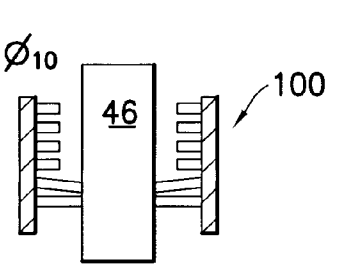
Figure 10L:
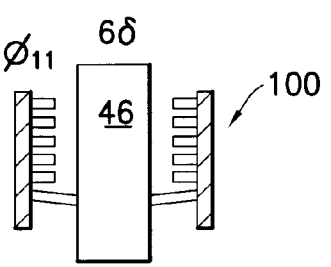

FIG. 10E illustrates a fifth phase in which a third dynamic seal element 104*c* is closed to engage an outer surface of the logging tool 46. The process is repeated for the lower dynamic seal elements in lower phases, essentially walking the logging tool 46 downward through the internal cavity of the adaptive seal assembly 100. By the end of the twelfth phase illustrated in FIG. 10L, the logging tool 46 has traveled a distance of six δ. In each phase of the sequence, at least one of the dynamic seal elements remains closed about the periphery of the logging tool 46 to maintain a pressure barrier between the user access aperture and the wellbore access aperture of the adaptive seal assembly 100.

The configuration of dynamic seal elements not involved in the particular step of the respective phase are illustrated in an open position, away from the logging tool 46. In some embodiments, one or more of these unused dynamic seal elements 104 can remain in a closed configuration without clamping the tool contributing to sealing against the logging tool while allowing translation of the tool. Sequencing of the dynamic seal elements 104 can be accomplished by a remote controller coupled to the actuators 106, 108 and preprogrammed with a preferred sequence. Thrust to the logging tool 46 can be provided in an opposite direction by essentially reversing the ordering of the phases. In some embodiments, other sequences of the dynamic seal elements can be used. Although six dynamic seal elements are provided in the illustrative embodiment, different numbers of dynamic seal elements can be provided to the same effect, with at least two elements to provide a step capability while maintaining a seal against the logging tool 46.

Figure 11:
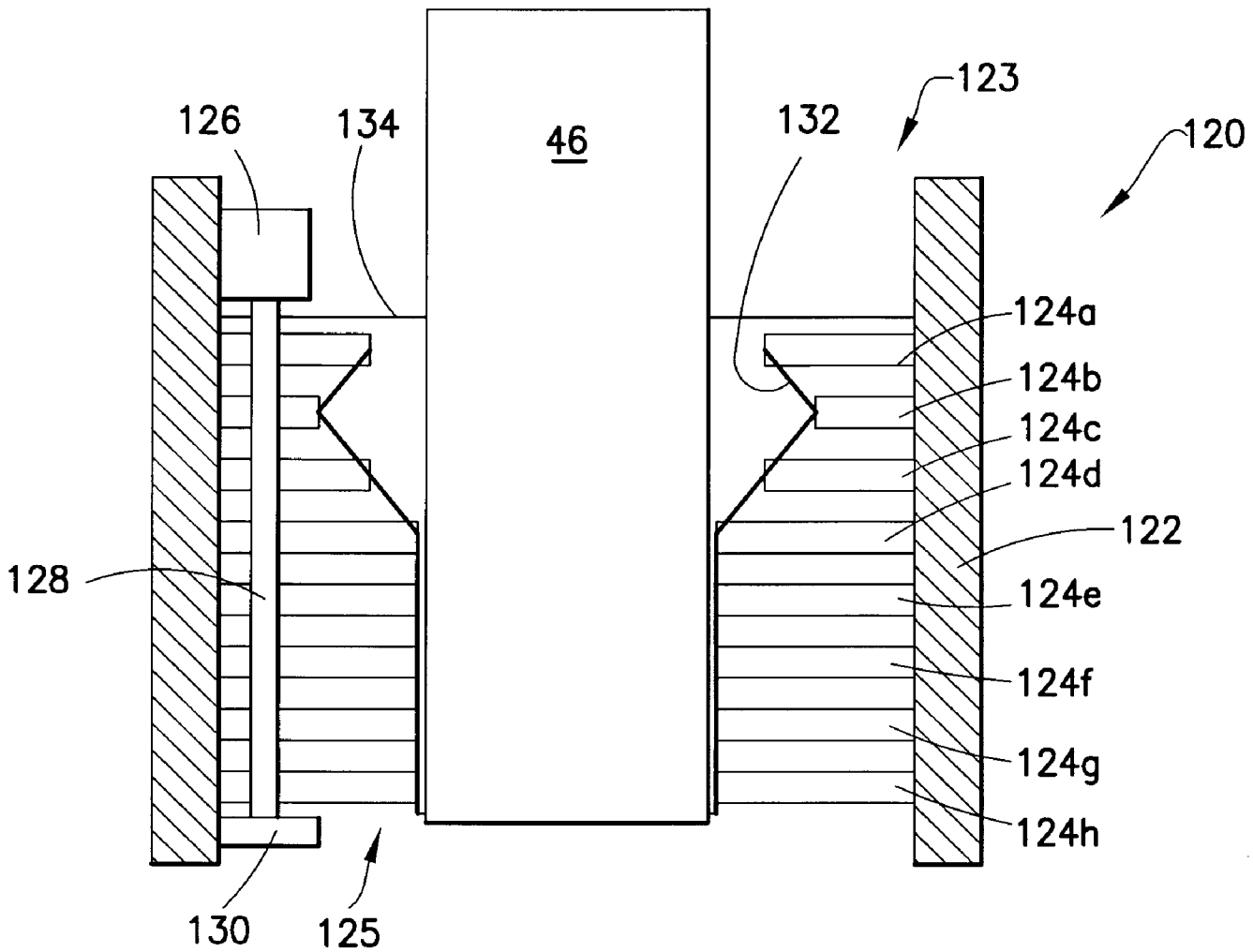
FIG. 11 is a schematic diagram of another embodiment of an adaptive sealing thrust assembly according to the present invention.

Another class of adaptive seal assemblies also including a thrust capability is illustrated in FIG. 11. The adaptive seal assembly 120 includes a housing 102 having a user access aperture 123 and a wellbore access aperture 125. A down-hole device, such as a logging tool 46, can be translated through either of the user access aperture 123 or the wellbore access aperture 125, depending upon the direction of travel, through an internal cavity of the housing 122 and out the opposite side of the adaptive seal assembly 120.

In the exemplary embodiment, the adaptive seal assembly 120 includes eight dynamic sealing elements 124*a* through 124*h* (generally 124). Each of the dynamic seal elements 124 includes an annular structure having a central aperture dimensioned to accommodate passage therethrough of a maximum cross section of a logging tool 46 can traverse. Each of the dynamic seal elements 124 is also configured to vary its internal aperture between open and closed positions. In an open position, the dynamic seal element 124 spaced away from the logging tool 46 leaving an open space between the perimeter of the aperture and a tool 46 disposed therein. In a closed position, the central aperture of the dynamic seal element 124 is urged toward the outer surface of the logging tool 46 substantially closing any open space. In at least some embodiments, each dynamic seal element 124 resides in a parallel plane, orthogonal to and spaced apart along a longitudinal axis of the logging tool 46. The dynamic seal element 124 can remain orthogonal to the longitudinal axis during transitions between open and closed positions.

In some embodiments, a single actuator, such as a rotary motor 126 rotates an elongated drive shaft 128, held at an opposite end by a rotary bearing 130. The drive shaft 128 can be coupled to each of the dynamic seal elements 124 through a respective transmission, transferring motor torque to the dynamic seal element 124. Sequencing of the different dynamic seal elements 124 can be accomplished by an initial positioning, or keying of the dynamic seal elements 124 with respect to each other. As the motor is turned, the relative positioning of the dynamic seal elements is maintained. In other embodiments, more than one actuators are provided. For example, each dynamic seal element 124 can be configured with a respective actuator to independently adjust the dynamic seal elements 124 between open and closed positions. A controller can be used to provide a control signal to each of the dynamic seal elements 124, maintaining a relative positioning of the dynamic seal elements throughout the phase sequence.

In some embodiments, the assembly 120 also includes an elongated, flexible tubular membrane 132 disposed between the logging tool 46 and the internal apertures of the dynamic seal elements 124. Preferably, the tubular membrane 132 is attached to each of the dynamic seal elements 124, such that the membrane flexes with opening and closing of the dynamic seal elements 124. With such a configuration, thrust can be generated in the logging tool 46 by expanding and contracting each of the dynamic seal elements 124 according to a controlled sequence of expansions and contractions. In some embodiments, the sequence of expansions and contractions form an undulating wave directed along the wellbore axis. When a fluid 134 is trapped between the tubular membrane 132 and the outer surface of the logging tool 46, the annular wave entrapping a portion of the fluid pushes against the fluid trapped therein, causing the logging tool 46 to be displaced along the wellbore axis, in the direction of the traveling wave according to thin film fluid mechanics. The first three dynamic seal elements 124*a*, 124*b*, 124*c* are sequenced to form a wave entrapping fluid 134 in a pocket formed in the tubular membrane 132. Exemplary devices are described in U.S. patent application Ser. No. 11/247,918, entitled "Mechanical crawler", filed on Oct. 11, 2005.

Figure 12A:
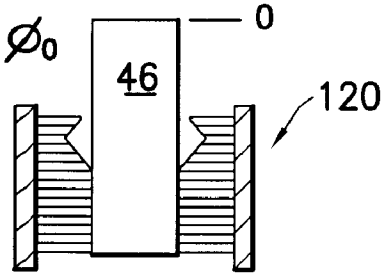
FIG. 12A through FIG. 12H together illustrate the adaptive sealing thrust assembly of FIG. 11 applying thrust to a tool according to the present invention.

Referring now to FIG. 12A through FIG. 12H together, a sequencing of the dynamic seal elements in a controlled manner is illustrated for applying a thrust to the logging tool 46, urging the logging tool in a downward direction through the internal cavity of the adaptive seal assembly 120. In the exemplary embodiment, there are eight phases, phase 0 through phase 7. Referring to FIG. 12A illustrating phase 0, a first and third dynamic seal elements 124*a* and 124*c* are illustrated in a partially open position, a second dynamic seal element 124*b* is illustrated in a full open position, and the remainder of the dynamic seal elements 124*d* through 124*h* are in a closed position. The first three dynamic seal elements 124*a*, 124*b*, 124*c* form an annular wave open at the top end to allow a fluid to enter and fill a void caused by the wave. A zero reference is drawn at the top of the logging tool 46 for reference as the logging tool is translated through the different phases.

Figure 12B:
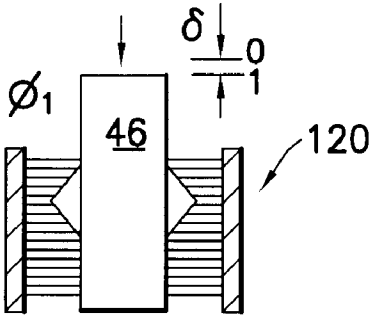
Figure 12C:
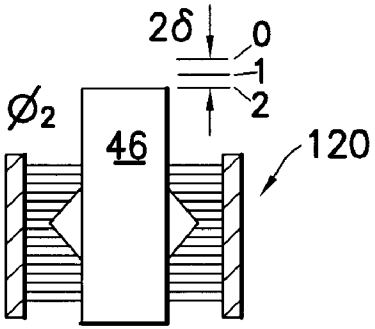
Figure 12D:
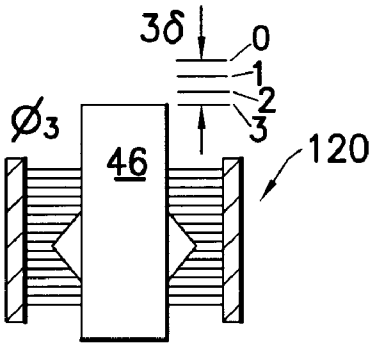
Figure 12E:
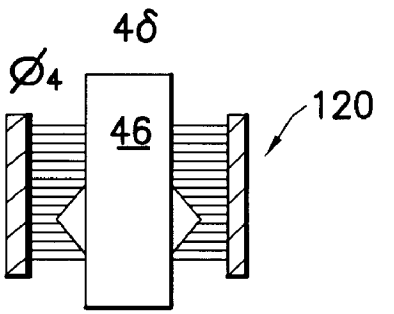
Figure 12F:
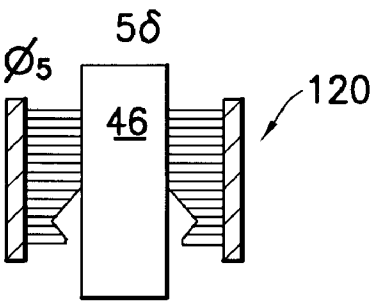
Figure 12G:
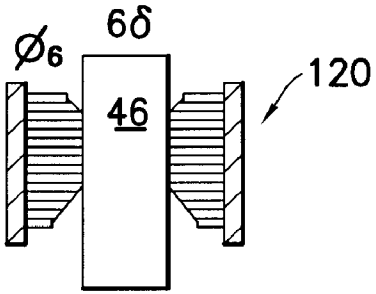
Figure 12H:
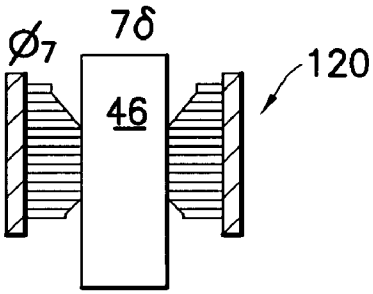

Referring next to FIG. 12B, the first through fourth dynamic seal elements 124*a* through 124*d* form a closed annular wave. Essentially, the wave created in phase Ø has progressed downward by an amount δ, the spacing between adjacent dynamic seals, the logging tool also being translated by a corresponding amount δ according to thin film principles. The process is repeated for subsequent phases illustrated in FIG. 12C through FIG. 12H with the wave motion urging the logging tool 46 downward through the internal cavity of the adaptive seal assembly 120. By the end of the twelfth phase illustrated in FIG. 12H, the logging tool 46 has traveled a distance of about seven δ. Thus, an axial thrust can be produced along the wellbore axis by dynamic seal elements variations in planes orthogonal to the axis. In each phase of the sequence, at least one of the dynamic seal elements remains closed about the periphery of the logging tool 46. This insures that a pressure barrier is established between the user access aperture and the wellbore access aperture of the adaptive seal assembly 120. Sequencing of the dynamic seal elements 124 can be accomplished by a remote controller coupled to the actuator 126 and preprogrammed with a preferred sequence. Thrust to the logging tool 46 can be provided in an opposite direction by essentially reversing the order of the phases. Although eight dynamic seal elements are provided in the illustrative embodiment, different numbers of dynamic seal elements can be provided to the same effect.

Figure 13A:
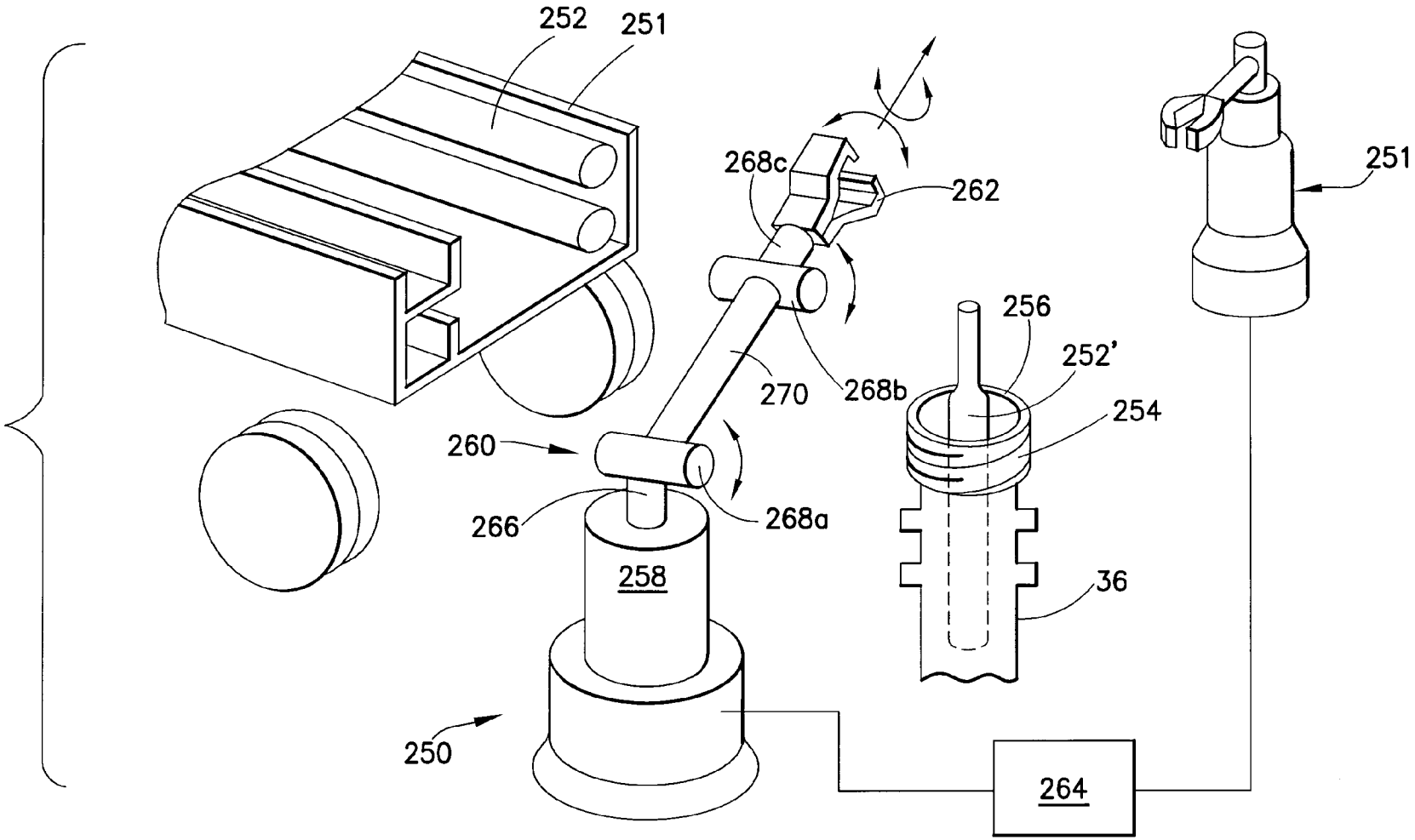
FIG. 13A and FIG. 13B are perspective views of an embodiment of a robotic system for automatically manipulating a wellbore deployment system during use according to the present invention.
Figure 13B:
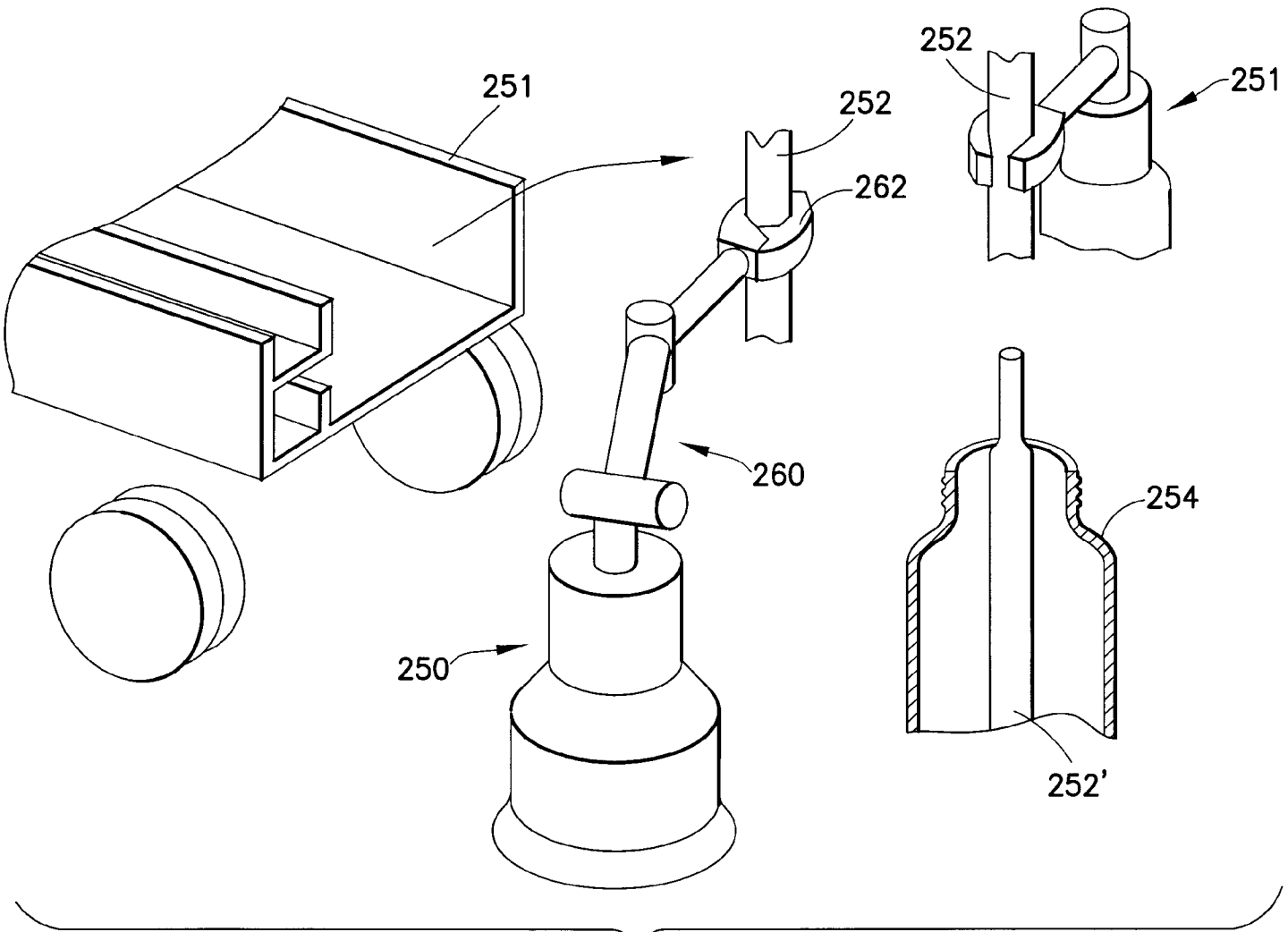

Referring now to FIG. 13A and FIG. 13B, a robotic system 250 can be provided to assist in manipulation and positioning of at least one of the down-hole device 252 and the adaptive seal assembly 254. A pick-and-place robotic system 250 can include a base member 258 and a positionable arm 260 attached at one end to the base unit 258. A releasably grasping fixture 268 is provided at an opposite end of the arm 260. In some embodiments, the releasably grasping fixture can be a clamp or a grasper 262 as shown. The elements of the pick-and-place robotic system 250 are configured to provide multiple degrees of freedom. In some embodiments, the robotic system 250 includes a controller 264 in electrical communication with the system 250. The controller 264 can include a processor executing preprogrammed instructions coupled to the robotic system 250 through a cable. Alternatively or in addition, the controller 264 includes a user interface to allow an operator to at least contribute to operation of the robotic system 250. Preferably, the robotic system 250 requires minimal operator intervention during use, to expedite manipulations of the tool 252 or assembly 254.

In some embodiments, the robotic system 250 is positioned in relation to a stowed tool 252 and a user access aperture 256 of the adaptive seal assembly 254 such that the grasper 262 is moveable between the stowed tool 252 and the assembly 254 without having to relocate the base unit 258. The robotic system 250 includes sufficient degrees of freedom to allow the grasper 262 to access the stowed tool 252 and translate the stowed tool 252 to a position above the user access aperture 256 of the assembly 254. In some embodiments, the robotic system 250 is also capable of lowering the tool 252 into an internal cavity of the assembly 254 and into a wellhead fixture 36 as shown. The tools 252 can be stowed on the bed of a tool delivery vehicle such as a truck or rail vehicle as shown. Such precise robotic manipulation of tools 252 and/or assemblies 254 with respect to the wellhead fixtures 36 reduces the time and complexity associated with inserting and extracting tools from a well under pressure.

In some embodiments, the pick-and-place robotic system 250 includes a vertical mast 266 coupled at one end to the base unit 258 and at an opposite end to one end of an arm 260. The vertical mast 266 can be angled in some embodiments. Alternatively or in addition, the vertical mast can include an extendable portion allowing the mast to extend and contract along an axis of the mast. A first joint 268*a* is attached between the vertical mast 266 and the arm 260 allowing relative movement between the arm 260 and the vertical mast 266. The arm 260 includes a boom 270 coupled at one end to the first joint 268*a* and at an opposite end to a second joint 268*b*. A third joint 268*c* can be coupled between the second joint 268*b* and the grasper unit 262. Preferably, at least one of the base unit 258 and the vertical mast 262 is able to rotate with respect to the other.

In some embodiments, the robotic system includes a seven degrees-of-freedom (DOF) similar to that of a human arm. Such a configuration provides mobility for the robotic system 250 to grasp items such as tools 252 and/or adaptive seal assemblies 254 from different angles or directions. More or less degrees of freedom can be provided in various embodiments of the robotic system 250.

In some embodiments, a robotic system 251 includes a selective compliant assembly robot arm (SCARA). Such a SCARA configuration can provide a four-axis robot arm able to move to any XYZ coordinate within a work envelope. The fourth axis of motion is a wrist allowing a rotation of a grasper about the arm. Such a configuration can be accomplished with three parallel axis rotary joints. Vertical motion can be provided at an independent linear axis at the wrist or in the base of the robotic system 250. SCARA robots 251 are particularly useful in situations in which a final movement is to insert a grasped part using a single vertical move. Thus, the SCARA robot 251 is advantageous for many types of pick-and-place assembly applications, particularly those in which an elongated item is placed within a hole without binding.

Figure 14:
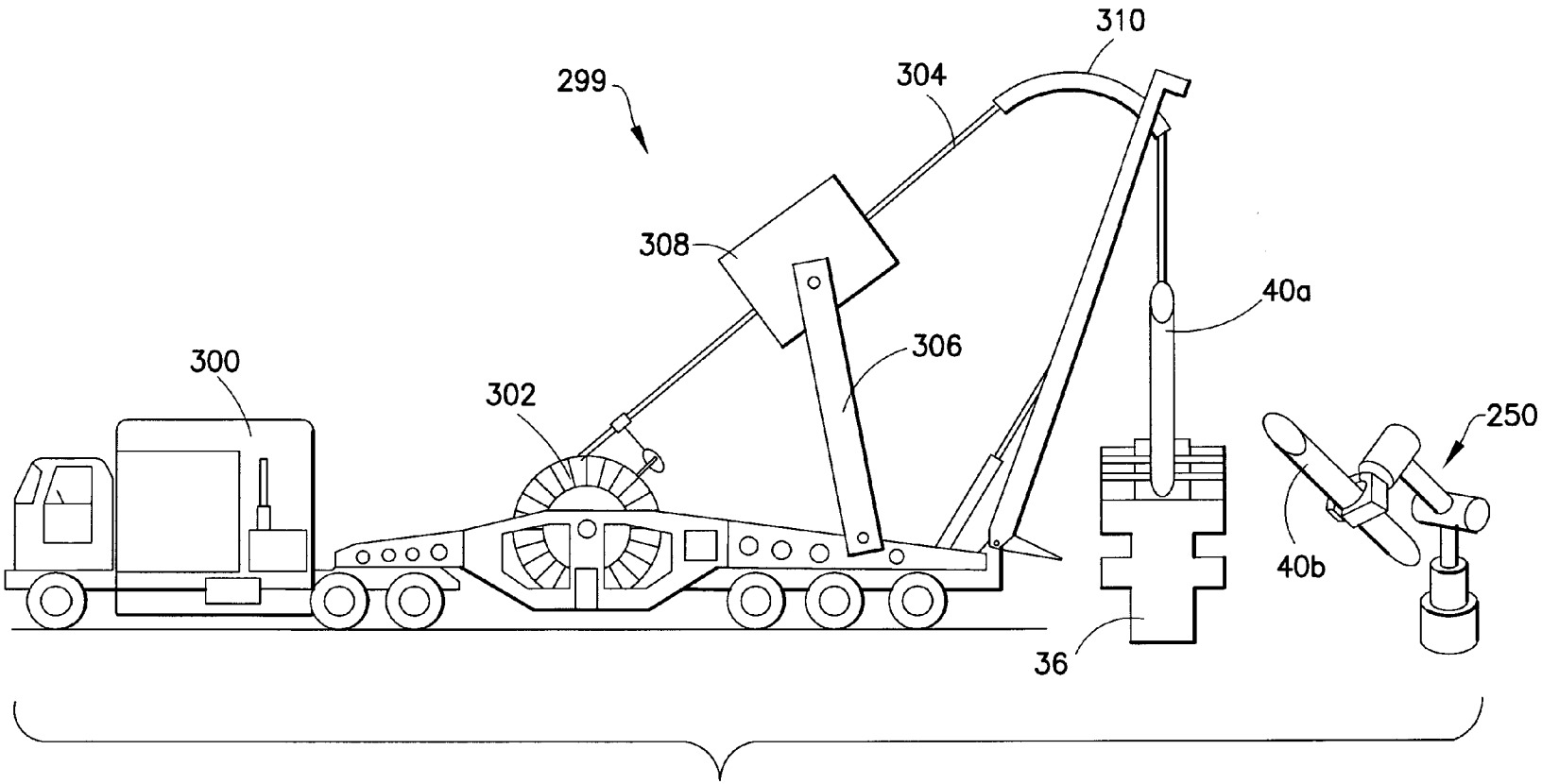
FIG. 14 is a side elevation view of an embodiment of a coiled tubing system for injecting or removing coiled tubing from a borehole according to the present invention.

FIG. 14 illustrates a general rigless coiled tubing deployment system 299 architecture in which a coiled tubing injector 204 exerts thrust onto one or more tools of a tool array. The deployment system 299 can include mobile platform, such as a truck 300 having a trailer portion with a coiled tubing reel 302 mounted thereon, onto which a length of coiled tubing 304 is at least partially wound. The system 299 also includes a coiled tubing thrust unit 308 positioned along a length of the coiled tubing 304 between the reel 302 and the tool 40*a*. In some embodiments, the thrust unit 308 is supported by a boom 306 pivotally attached to a trailer portion of the truck 300.

During an insertion procedure, the coiled tubing thrust unit 308 provides a thrust directed away from the coiled tubing reel 302. The thrust unit 308 extracts a length of coiled tubing 304 from the reel and directs it upward at a slope and through a bend 310 into vertical alignment above the tool 40*a*. The tool 40*a* can be at least partially positioned within a wellhead fixture 36 as illustrated. Thrust applied by the coiled tubing thrust unit 308 extracts greater lengths of coiled tubing 304 from the coiled tubing reel 302, forcing it around the bend 310 and directing it downward into the well. The wellhead fixture 36 can include seals adapted to seal against the coiled tubing allowing the coiled tubing to thrust the tool 40*a* further downhole while maintaining pressure differential within the well. Also illustrated is a robotic system 250 adjacent to the wellhead fixture 36 that can be used in combination with the rigless coiled tubing system 299. The robotic system 250 is shown grasping a second instrument 40*b* in anticipation for positioning it above an open end of the wellhead fixture 36 once the first instrument has been inserted. The end of the coiled tubing 304 coupled to the first tool 40*a* can be disconnected once the first tool 40*a* is sufficiently inserted into the open end of the wellhead fixture 36, and reconnected to a proximal end of the second tool 40*b*. The process can be repeated as necessary for additional tools of a tool array.

Figure 15:
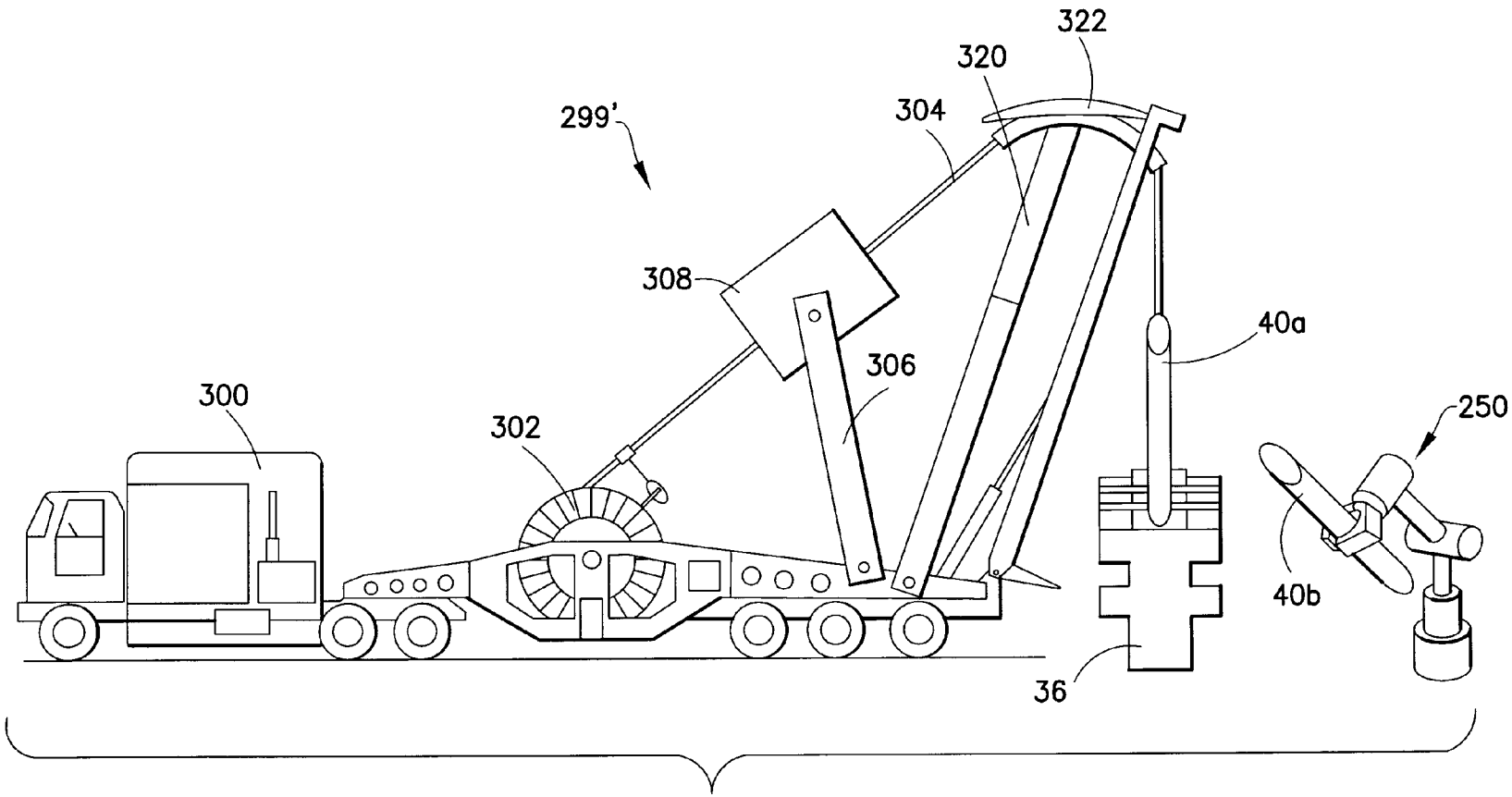
FIG. 15 is a side elevation view of another embodiment of a coiled tubing system for injecting or removing coiled tubing from a borehole according to the present invention.

An alternative embodiment of a coiled tubing deployment system 299' is illustrated in FIG. 15. In this embodiment, a second boom 320 is provided attached at a base end to a portion of the truck 300 and having at its opposite end a bearing surface 322. The second boom is positioned between the coiled tubing thrust unit 308 and the wellhead fixture 36. Preferably, the second boom aligns the bearing surface 322 at the bend 310 portion of the coiled tubing. The bearing surface 322 can be used to assist in directing the coiled tubing 304 around the bend from the coiled tubing thrust unit 308 and into vertical alignment with a proximal end of logging tool 40*a* or wellhead fixture 36.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for transferring a down-hole device across an open end of a well under pressure, comprising:

attaching one end of an adaptive seal assembly that includes one or more dynamic seal elements;

the adaptive seal assembly accessible at both ends and defining a passage therethrough, to the open end of the well under pressure;

positioning the down-hole device at least partially within the passage defined by the adaptive seal assembly;

sealing an interior region defined between an interior surface of a housing of the adaptive seal assembly and an adjacent periphery of the down-hole device by providing at least one adjustable annulus disposed within an interior region of the housing and within a plane perpendicular to a wellbore axis;

adjusting the adjustable annulus between open and closed configurations, wherein a seal between the interior surface of the enclosed side wall and an adjacent periphery of the down-hole device is obtained by the closed configuration, whereby an elevated wellbore pressure is maintainable on one side of the adjustable annulus against atmospheric pressure on another side of the annulus;

applying an axial force to a proximal end of the down-hole device, wherein the down-hole device is translatable by application of the axial force through the open end of the well under pressure;

automatically readjusting the seal between the housing and the down-hole device responsive to cross sectional variations of the down-hole device, wherein pressure isolation is maintained as the down-hole device is translated; and wherein adjusting the adjustable annulus comprises automatically controlling an actuator configured to adjust the adjustable annulus between open and closed configurations, an external perimeter of the adjustable annulus remaining constant during adjustment, while an internal perimeter of the adjustable annulus dimensionally varies during adjustment.

2. The method of claim 1, wherein the act of applying axial force comprises applying a compressional force introducing the down-hole device into the open end of the well under pressure.

3. The method of claim 1, wherein the act of applying axial force comprises applying a tensional force extracting the down-hole device from the open end of the well under pressure.

4. The method of claim 1, wherein the act of applying the axial force comprises:

coupling a distal end of a mechanical linkage to the proximal end of the down-hole device; and activating a mechanical linkage thrust unit configured to translate the distal end of the mechanical linkage along the wellbore axis.

5. The method of claim 1, further comprising sensing a pressure exerted between an edge of the internal perimeter of the adjustable annulus and the adjacent periphery of the down-hole device.

6. The method of claim 5, further comprising controlling the actuator configured to adjust the adjustable annulus responsive to the sensed pressure exerted between the edge of the internal perimeter of the adjustable annulus and the adjacent periphery of the down-hole device, wherein the pressure exerted therebetween is maintainable by the adjustment within a tolerance during translation of the down-hole device.

7. The method of claim 1, further comprising:

transferring the down-hole device between a storage location and the open end of the well under pressure; and positioning the down-hole device relative to the open end of the well under pressure, wherein at least one of the acts of transferring and positioning is accomplished using a robotic manipulator.

8. The method of claim 1, wherein the act of applying axial force comprises:

clamping the down-hole device with respect to the housing at a first axial position using a first dynamic clamping device; and translating the first dynamic clamping device along the wellbore axis, wherein the clamped down-hole device is also translated along a wellbore axis.

9. The method of claim 8, further comprising:

clamping the down-hole device with respect to a frame at a second axial position using a second dynamic clamping device; and unclamping the first dynamic clamping device; and translating the second dynamic clamping device along the wellbore axis, wherein the clamped down-hole device is further translated along the wellbore axis.

10. The method of claim 9, further comprising translating the unclamped first dynamic clamping device in an opposite direction along the wellbore axis with respect to the second dynamic clamping device.

11. The method of claim 10, wherein the act of sealing comprises sealingly clamping the entire periphery of the down-hole device using at least one of the first and second dynamic clamping devices.

12. The method of claim 1, wherein the act of applying the axial force comprises:

configuring a plurality of axially arranged transverse dynamic seal elements to form an axially directed annular wave with respect to the periphery of the down-hole device;

entrapping a fluid in an annular region between the dynamic seal elements and the down-hole device; and sequencing opening and closing of at least some of the plurality of axially arranged transverse dynamic seal elements to translate the axially directed annular wave along the wellbore axis.

13. An apparatus for transferring a down-hole device across an open end of a well under pressure, comprising:

a housing having an enclosed side wall open at both ends and defining a passage therethrough;

a mounting flange at one end of a frame configured for securely mounting the frame in relation to the open end of the well under pressure;

at least more than one dynamic seal elements spaced apart along a wellbore axis and positioned within an interior region defined between an interior surface of the enclosed side wall and a respective adjacent periphery of the down-hole device, each of the more than one dynamic seal elements configured to independently seal a respective interior region between the interior surface of the enclosed side wall and a respective adjacent periphery of the down-hole device at an elevated wellbore pressure and atmospheric pressure; and an actuator configured to adjust the at least more than one dynamic seal element between open and closed configurations, a sealing engagement being provided in the closed configuration.

14. The apparatus of claim 13, wherein each of the at least more than one dynamic seal elements comprises a respective adjustable annulus operable between open and closed configurations, each respective adjustable annulus having a dimensionally variable internal perimeter configured to seal a respective periphery of the down-hole device with respect to the interior surface of the housing in its respective closed configuration.

15. The apparatus of claim 14, wherein at least one of the adjustable annuli defines an interior edge comprising a compliant material configured for sealing engagement between the respective dynamic adjustable annulus and the respective periphery of the down-hole device.

16. The apparatus of claim 15, further comprising a sensor configured to monitor an indication of the sealing engagement between the interior edge of the annulus and the periphery of the down-hole device.

17. The apparatus of claim 16, further comprising a controller in communication with the sensor and the actuator, the controller configured to adjust the adjustable annulus to a closed configuration by an amount to ensure a sealing engagement between the interior edge of the annulus; and the periphery of the down-hole device is maintained within a pressure range during translation of the down-hole device.

18. The apparatus of claim 13, wherein each of the more than one dynamic seal elements comprises a respective adjustable annulus independently operable between open and closed configurations, each adjustable annulus configured to seal against different respective diameter range of periphery of the down-hole device.

19. The apparatus of claim 18, wherein each of the more than one the adjustable annuli defines a respective interior edge comprising a compliant material positioned thereon for sealing engagement between the adjustable annulus and the respective adjacent periphery of the down-hole device.

20. The apparatus of claim 13, further comprising a robotic manipulator for accomplishing at least one of transferring the down-hole device between a storage location and the open end of the well under pressure, and positioning the down-hole device with respect to the open end of the well under pressure.

21. The apparatus of claim 13, further comprising an integral thrust unit configured to translate the down-hole device across the open end of the well under pressure.

22. The apparatus of claim 21, wherein the integral thrust unit comprises:

a first clamping device configured to clamp the down-hole device to the housing at a first axial position; and a first actuator configured to translate the first clamping device along the wellbore axis, wherein the clamped down-hole device is also translated along the wellbore axis, when clamped by the first clamping device.

23. The apparatus of claim 22, wherein the integral thrust unit further comprises:

a second clamping device configured to clamp the down-hole device to the housing at a second axial position; and a second actuator configured to translate the second clamping device along the wellbore axis, wherein the clamped down-hole device is further translated along the wellbore axis, when clamped by the second clamping device.

24. The apparatus of claim 23, wherein at least one of the first and second clamping devices comprises a compliant surface for sealing against the periphery of the down-hole device.

25. The apparatus of claim 24, wherein the compliant surface comprises more than one layer of different material each providing a different respective compliance.

26. A system for transferring a down-hole device across an open end of a well under pressure, comprising:

means for attaching one end of an adaptive seal assembly that includes one or more dynamic seal element;

the adaptive seal assembly accessible at both ends and defining a passage therethrough, to the open end of the well under pressure;

means for positioning the down-hole device at least partially within the passage defined by the adaptive seal assembly;

means for sealing an interior region defined between an interior surface of an enclosed side wall and an adjacent periphery of the down-hole device, whereby an elevated wellbore pressure within the well under pressure is isolated from ambient pressure;

means for providing an adjustable annulus disposed within an interior region of the housing and within a plane perpendicular to a wellbore axis;

means for adjusting the adjustable annulus between open and closed configurations, wherein a seal between the interior surface of the enclosed side wall and an adjacent periphery of the down-hole device is obtained by the closed configuration, whereby the elevated wellbore pressure is maintainable on one side of the adjustable annulus against atmospheric pressure on another side of the annulus;

means for automatically controlling an actuator configured to adjust the adjustable annulus between open and closed configurations; an external perimeter of the adjustable annulus remaining constant during adjustment, while an internal perimeter of the adjustable annulus dimensionally varies during adjustment;

means for applying an axial force to a proximal end of the down-hole device, wherein the down-hole device is translatable by application of the axial force through the open end of the well under pressure; and means for automatically readjusting the seal between the housing and the down-hole device responsive to cross sectional variations of the down-hole device, wherein pressure isolation is maintained as the down-hole device is translated.

* * * * *